US005358650A

United States Patent [19]

Srinivasan et al.

[11] Patent Number: 5,358,650

[45] Date of Patent: Oct. 25, 1994

[54] GEAR OIL COMPOSITIONS

[75] Inventors: Sanjay Srinivasan; Rolfe J. Hartley, both of St. Louis, Mo.

[73] Assignee: Ethyl Corporation, Richmond, Va.

[21] Appl. No.: 41,791

[22] Filed: Apr. 1, 1993

[51] Int. Cl.[5] ..... C10M 111/02; C10M 111/04

[52] U.S. Cl. ..... 252/45; 252/51.5 A; 252/56 S; 252/56 R; 252/49.6

[58] Field of Search ..... 252/45, 49.6, 56 D, 252/51.5 A, 56 S, 56 R

[56] References Cited

U.S. PATENT DOCUMENTS 5,137,980 8/1992 DeGonia ..... 525/327.6

*Primary Examiner*—Jacqueline V. Howard
*Attorney, Agent, or Firm*—John F. Sieberth

[57] ABSTRACT

A "cold-clash" gear problem associated with vehicular manual transmissions exposed to the cold is overcome by use of a special all-synthetic gear oil composition. The composition is composed of base oil and specified additive components. The base oil is a blend of di-(2-ethylhexyl)sebacate and three hydrogenated poly-α-olefin oligomers having kinematic viscosities at 100° C. of about 40, about 8 cSt and about 2 cSt in specified proportions. The additive components comprise an organic sulfur-containing antiwear and/or extreme pressure agent, an organic phosphorus-containing antiwear and/or extreme pressure agent, a copper corrosion inhibitor, a rust inhibitor, a foam inhibitor, and an ashless dispersant. The gear oil has a boron content of about 0.0025 to about 0.07 wt %.

5 Claims, No Drawings

GEAR OIL COMPOSITIONS

TECHNICAL FIELD

This invention relates to gear oils, and more particularly to manual transmission gear oils that have the capability of sharply reducing if not eliminating clashing of gears under low temperature conditions.

TECHNICAL PROBLEM SOLVED BY THE INVENTION

A "cold-clash" gear problem has recently been experienced by at least one well-known commercial manufacturer of manual transmissions for passenger cars and other vehicles. When the transmission is cold, as during initial vehicle operation after exposure to the cold during winter months in cold climatic regions of the world, the transmission does not operate properly. The operator usually finds it necessary to exert excessive force upon the gear shift lever and in addition there can be and often is a pronounced clashing of the gears during the shifting operations. While the source of the problem is not known with certainty, it is a real world problem crying for a solution. As a matter of fact, even use of the best current factory-fill synthetic 75W-90 GL-4 gear oil fails to alleviate this perplexing problem.

THE INVENTION

This invention provides an effective solution to the cold-clash problem.

Pursuant to one embodiment of this invention there is provided an essentially metal-free and essentially halogen-free, boron-containing gear oil lubricant composition which comprises:

a) base oil consisting essentially of a blend of (1) di-(2-ethylhexyl)sebacate; (2) hydrogenated poly-α-olefin oligomer having a kinematic viscosity at 100° C. of about 40 cSt; (3) hydrogenated poly-α-olefin oligomer having a kinematic viscosity at 100° C. of about 8 cSt; and (4) hydrogenated poly-α-olefin oligomer having a kinematic viscosity at 100° C. of about 2 cSt, in proportions such that for each 100 parts by weight of (2) there are from about 24 to about 40 parts by weight of (1), from about 3 to about 12 parts by weight of (3), and from about 11 to about 20 parts by weight of (4);

b) about 0.7 to about 7 wt % of at least one oil-soluble organic sulfur-containing antiwear and/or extreme pressure agent having a sulfur content of at least about 20% by weight;

c) about 0.2 to about 3 wt % of at least one oil-soluble organic phosphorus-containing antiwear and/or extreme pressure agent;

d) about 0.05 to about 0.35 wt % of at least one oil-soluble copper corrosion inhibitor;

e) about 0.1 to about 0.8 wt % of at least one oil-soluble rust inhibitor;

f) about 0.005 to about 0.06 wt % of at least one oil-soluble foam inhibitor; and g) about 0.15 to about 3 wt % of at least one oil-soluble ashless dispersant;

all of the foregoing percentages being based on the weight of the total composition, said composition being still further characterized in that the sulfur:phosphorus weight ratio of said composition is in the range of about 8:1 to about 35:1, and in that the boron content of said composition is in the range of about 0.0025 to about 0.07 wt %.

Use of such a composition has been found to sharply reduce if not totally eliminate the cold-clash problem. Thus another embodiment of this invention is the method of alleviating the problem of cold-clashing of gears in a manual transmission after the transmission has been exposed to low temperature climatic conditions, which method comprises providing as the lubricant in said transmission a gear oil composition of this invention. Still another embodiment is the method of operating a manual transmission when the transmission has been exposed to low temperature climatic conditions, which method comprises lubricating said transmission with a gear oil composition of this invention.

The base oil of the compositions of this invention is made up of four essential components, namely one synthetic ester and three different hydrogenated oligomers of specified viscosities, and these components are employed in specified proportions relative to each other. The synthetic ester is di-(2-ethylhexyl)sebacate. If necessary, other dioctyl sebacate isomers may be used together with or in lieu of the di-(2-ethylhexyl)sebacate, provided that the viscosity and compatibility characteristics of the ester or ester mixture are substantially the same as technical grade di-(2-ethylhexyl)sebacate itself.

The other three essential components of the base oil are all derived by oligomerization of a 1-alkene having in the range of 6 to 20, preferably 8 to 16, more preferably 10 to 12 and most preferably 10, carbon atoms in the molecule, and hydrogenation of the resultant oligomers. The hydrogenated poly-α-olefin oligomer having the highest viscosity of the three has a kinematic viscosity at 100° C. of about 40 cSt. Of the three oligomers, the hydrogenated poly-α-olefin oligomer of next highest viscosity has a kinematic viscosity at 100° C. of about 8 cSt. The hydrogenated poly-α-olefin oligomer with the lowest viscosity of the three oligomers has a kinematic viscosity at 100° C. of about 2 cSt.

The four essential components of the base oil are employed in proportions, on a weight basis, such that for each 100 parts of the 40 cSt oligomer there are from about 24 to about 40 parts preferably from about 28 to about 36 parts, and more preferably about 30 to about 34 parts of the di-(2-ethylhexyl) sebacate; from about 3 to about 12 parts, preferably from about 3 to about 6 parts, and more preferably from about 3 to about 4 parts of the 8 cSt oligomer; and from about 11 to about 20 parts, preferably from about 15 to about 20 parts, and more preferably about 18 to about 20 parts of the 2 cSt oligomer. A most preferred base oil blend consists of about 32 parts by weight of the sebacate ester, about 100 parts by weight of the 40 cSt oligomer, from about 3 to about 4 parts by weight of the 8 cSt oligomer, and about 18 to about 20 parts by weight of the 2 cSt oligomer.

Metal-free sulfur-containing antiwear and/or extreme pressure agents used in the practice of this invention include dihydrocarbyl polysulfides; sulfurized olefins; sulfurized fatty acid esters of both natural and synthetic origins; trithiones; sulfurized thienyl derivatives; sulfurized terpenes; sulfurized polyenes; sulfurized Dieis-Alder adducts, etc., provided that the sulfur content of the product is at least about 20 wt %, preferably at least about 30 wt %, and most preferably at least about 40 wt %. Specific examples include sulfurized isobutylene, sulfurized diisobutylene, sulfurized triisobutylene, dicyclohexyl polysulfide, diphenyl polysulfide, dibenzyl polysulfide, dinonyl polysulfide, and mixtures of di-tert-butyl polysulfides such as mixtures of di-tert-butyl trisulfide, di-tert-butyl tetrasulfide and di-tert-butyl pentasulfide, among others. Combinations of different types of metal-free sulfur-containing antiwear and/or extreme pressure agents can also be used, again provided that the combination has an average sulfur content of at least about 20 wt %, preferably at least 30 wt % and most preferably at least 40 wt %. Examples of suitable combinations include combinations of sulfurized isobutylene and di-tert-butyl trisulfide, combinations of sulfurized isobutylene and dinonyl trisulfide, combinations of sulfurized tall oil and dibenzyl polysulfide, and the like. The most preferred oil-soluble metal-free sulfur-containing antiwear and/or extreme pressure agents from the cost-effectiveness standpoint are the sulfurized olefins containing at least about 40% by weight of sulfur, the dihydrocarbyl polysulfides containing at least about 40% by weight of sulfur, and mixtures of such sulfurized olefins and polysulfides. Of these materials, sulfurized isobutylene having a sulfur content of at least 40% by weight and a chlorine content of less than 0.2% by weight is the most especially preferred material. Methods of preparing sulfurized olefins are described in U.S. Pat. Nos. 2,995,569; 3,673,090; 3,703,504; 3,703,505; 3,796,661; and 3,873,454. Also useful are the sulfurized olefin derivatives described in U.S. Pat. No. 4,654,156.

Typical metal-free phosphorus--containing antiwear and/or extreme pressure additives used in the practice of this invention include esters of phosphorus acids, amine salts of phosphorus acids and phosphorus acid-esters, and partial and total thio analogs of the foregoing. In this connection, for the purposes of this invention an antiwear and/or extreme pressure agent that contains both phosphorus and sulfur in the molecule is deemed a phosphorus-containing antiwear and/or extreme pressure agent. Examples of suitable compounds which may be used as phosphorus-containing antiwear and/or extreme pressure agents include trihydrocarbyl phosphites, phosphonates and phosphates, and dihydrocarbyl phosphites; such as tricresyl phosphate, cresyl diphenyl phosphate, tributyl phosphate, trioleyl phosphate, trilauryl phosphate, tributyl phosphite, trioctyl phosphite, triphenyl phosphite, tricresyl phosphite, tricyclohexyl phosphite, dibutyl lauryl phosphonate, dibutyl hydrogen phosphite, dioleyl hydrogen phosphite, and tolyl phosphinic acid dipropyl ester. Typical sulfur analogs of such compounds are illustrated by tricresyl mono-, di-, tri-, and tetrathiophosphates, tris(decyl) mono-, di-, tri-, and tetrathiophosphates, trinonyl mono-, di-, and trithiophosphites, dioleyl ester of hexadecylthiophosphonic acid, and amyl thiophosphinic acid dimyristyl ester. Among the amine salts which can be employed are amine salts of partially esterified phosphoric, phosphorous, phosphonic, and phosphinic acids and their partial or total thio analogs such as partially esterified monothiophosphoric, dithiophosphoric, trithiophosphoric and tetrathiophosphoric acids; amine salts of phosphonic acids and their thio analogs; and the like. Specific examples include the dihexylammonium salt of dodecylphosphoric acid, the diethyl hexyl ammonium salt of dioctyl dithiophosphoric acid, the octadecylammonium salt of dibutyl thiophosphoric acid, the dilaurylammonium salt of 2-ethylhexylphosphoric acid, the dioleyl ammonium salt of butane phosphonic acid, and analogous compounds.

Among the preferred materials for use as metal-free phosphorus-containing antiwear and/or extreme pressure additives are (i) at least one oil-soluble amine salt of a monohydrocarbyl and/or dihydrocarbyl ester of a phosphoric or thiophosphoric acid, such acid having the formula $$(HX^1)(HX^2)(HX^3)PX^4$$

wherein each of $X^1$, $X^2$, $X^3$ and $X^4$ is, independently, an oxygen atom or a sulphur atom, and most preferably wherein at least three of them are oxygen atoms; (ii) at least one oil-soluble phosphorus- and nitrogen-containing composition formed by reacting a hydroxy-substituted triester of a phosphorothioic acid with an inorganic phosphorus acid, phosphorus oxide or phosphorus halide to produce an acidic intermediate, and neutralizing a substantial portion of said acidic intermediate with at least one amine or hydroxy amine; (iii) at least one oil-soluble amine salt of a hydroxy-substituted phosphetane or a hydroxy-thiophosphetane (sometimes referred to as "phosphetans" or "thiophosphetans"); or a combination of any two or all three of (i), (ii) and (iii). The phosphorus- and nitrogen-containing compositions of type (ii) are described in G.B. 1,009,913; G.B. 1,009,914; U.S. Pat. No. 3,197,405 and/or U.S. Pat. No. 3,197,496. In general, these compositions are formed by forming an acidic intermediate by the reaction of a hydroxy-substituted triester of a phosphorothioic acid with an inorganic phosphorus acid, phosphorus oxide or phosphorus halide, and neutralizing a substantial portion of said acidic intermediate with an amine or hydroxy-substituted amine. The type (iii) phosphorus- and nitrogen-containing antiwear and/or extreme pressure additives which can be used in the compositions of this invention are the amine salts of hydroxy-substituted phosphetanes or the amine salts of hydroxy-substituted thiophosphetanes. Typically, such salts are derived from compounds of the formula

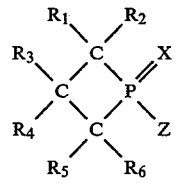

wherein each of $R_1$, $R_2$, $R_3$, $R_4$, $R_5$ and $R_6$ is a hydrogen atom or a carbon-bonded organic group such as a hydrocarbyl group or a substituted hydrocarbyl group wherein the substituent(s) do(es) not materially detract from the predominantly hydrocarbonaceous character of the hydrocarbyl group; X is a sulphur or an oxygen atom and Z is a hydroxyl group or an organic group having one or more acidic hydroxyl groups. Examples of this general type of antiwear and/or extreme pressure agent include the amine salts hydroxyphosphetanes and the amine salts of hydroxy-thiophosphetanes.

One type of copper corrosion inhibitors which are used in the practice of this invention is comprised of thiazoles, triazoles and thiadiazoles. Examples include benzotriazole, tolyltriazole, octyltriazole, decyltriazole, dodecyltriazole, 2-mercaptobenzothiazole, 2,5-dimercapto-1,3,4-thiadiazole, 2-mercapto-5-hydrocarbylthio-1,3,4-thiadiazoles, 2-mercapto-5-hydrocarbyldithio-1,3,4-thiadiazoles, 2,5-bis(hydrocarbylthio)-1,3,4-thiadiazoles, and2,5-bis-(hydrocarbyldithio)-1,3,4-thiadiazoles. The preferred compounds are the 1,3,4-thiadiazoles, especially the 2-hydrocarbyldithio-5-mercapto-1,3,4-dithiadiazoles and the 2,5-bis(hydrocarbyldithio)-1,3,4-thiadiazoles, a number of which are available as articles of commerce. Other suitable inhibitors of copper corrosion include ether amines; polyethoxylated compounds such as ethoxylated amines, ethoxylated phenols, and ethoxylated alcohols; imidazolines; and the like.

The compositions of this invention also contain a rust inhibitor. This may be a single compound or a mixture of compounds having the property of inhibiting corrosion of ferrous metal surfaces. Such materials include oil-soluble monocarboxylic acids such as 2-ethylhexanoic acid, lauric acid, myristic acid, palmitic acid, oleic acid, linoleic acid, linolenic acid, behenic acid, cerotic acid, etc., and oil-soluble polycarboxylic acids including dimer and trimer acids, such as are produced from tall oil fatty acids, oleic acid, linoleic acid, or the like. Other suitable corrosion inhibitors include alkenylsuccinic acids in which the alkenyl group contains 10 or more carbon atoms such as, for example, tetrapropenylsuccinic acid, tetradecenylsuccinic acid, hexadecenylsuccinic acid, and the like; long-chain $\alpha,\omega$-dicarboxylic acids in the molecular weight range of 600 to 3000; and other similar materials. Products of this type are currently available from various commercial sources, such as, for example, the dimer and trimer acids sold under the HYSTRENE trademark by the Humco Chemical Division of Witco Chemical Corporation and under the EMPOL trademark by Emery Chemicals. Another useful type of acidic corrosion inhibitors are the half esters of alkenyl succinic acids having 8 to 24 carbon atoms in the alkenyl group with alcohols such as the polyglycols. The corresponding half amides of such alkenyl succinic acids are also useful. Although added in acidic form, some or all of the carboxylic groups of these carboxylic acid type corrosion inhibitors may be neutralized by excess amine present in the compositions. Other suitable corrosion inhibitors include ether amines; acid phosphates; amines; polyethoxylated compounds such as ethoxylated amines, ethoxylated phenols, ethoxylated alcohols; imidazolines; and aminosuccinic acids or derivatives thereof represented by the formula:

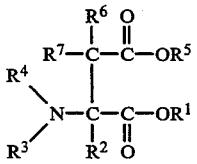

wherein each of $R^1$, $R^2$, $R^5$, $R^6$ and $R^7$ is, independently, a hydrogen atom or a hydrocarbyl group containing 1 to 30 carbon atoms, and wherein each of $R^3$ and $R^4$ is, independently, a hydrogen atom, a hydrocarbyl group containing 1 to 30 carbon atoms, or an acyl group containing from 1 to 30 carbon atoms. The groups $R^1$, $R^2$, $R^3$, $R^4$, $R^5$, $R^6$ and $R^7$, when in the form of hydrocarbyl groups, can be, for example, alkyl, cycloalkyl or aromatic containing groups. Preferably $R^1$ and $R^5$ are the same or different straight-chain or branched-chain hydrocarbon radicals containing up to 20 carbon atoms. Most preferably, $R^1$ and $R^5$ are saturated hydrocarbon radicals containing 3–6 carbon atoms. $R^2$, either $R^3$ or $R^4$, $R^6$ and $R^7$, when in the form of hydrocarbyl groups, are preferably the same or different straight-chain or branched-chain saturated hydrocarbon radicals. Preferably a dialkyl ester of an aminosuccinic acid is used in which $R^1$ and $R^5$ are the same or different alkyl groups containing 3–6 carbon atoms, $R^2$ is a hydrogen atom, and either $R^3$ or $R^4$ is an alkyl group containing 15–20 carbon atoms or an acyl group which is derived from a saturated or unsaturated carboxylic acid containing 2–10 carbon atoms. Most preferred of the aminosuccinic acid derivatives is a dialkylester of an aminosuccinic acid of the above formula wherein $R^1$ and $R^5$ are isobutyl, $R^2$ is a hydrogen atom, $R^3$ is octadecyl and/or octadecenyl and $R^4$ is 3-carboxy-1-oxo-2-propenyl. In such ester $R^6$ and $R^7$ are most preferably hydrogen atoms.

Suitable antifoam agents for use in the compositions of this invention include silicones and organic polymers such as acrylate polymers. Various antifoam agents are described in *Foam Control Agents* by H. T. Kerner (Noyes Data Corporation, 1976, pages 125–176). Mixtures of silicone-type antifoam agents such as the liquid dialkyl silicone polymers with various other substances are also effective. Typical of such mixtures are silicones mixed with an acrylate polymer, silicones mixed with one or more amines, and silicones mixed with one or more amine carboxylates. Other such mixtures include combinations of a dimethyl silicone oil with (i) a partial fatty acid ester of a polyhydric alcohol (U.S. Pat. No. 3,235,498); (ii) an alkoxylated partial fatty acid ester of a polyhydric alcohol (U.S. Pat. No. 3,235,499); (iii) a polyalkoxylated aliphatic amine (U.S. Pat. No. 3,235,501); and (iv) an alkoxylated aliphatic acid (U.S. Pat. No. 3,235,502).

The ashless dispersants utilized in the compositions of this invention include carboxylic ashless dispersants, Mannich base dispersants, polymeric polyamine dispersants, and post-treated dispersants of these types. At least some of the ashless dispersant used is a boronated ashless dispersant. These are typically formed by heating the dispersant to a suitable temperature above about 100° C. with a boronating agent. Procedures suitable for effecting boronation of ashless dispersants are described for example in U.S. Pat. Nos. 3,087,936; 3,254,025; 3,281,428; 3,282,955; 2,284,409; 2,284,410; 3,338,832; 3,344,069; 3,533,945; 3,658,836; 3,703,536; 3,718,663; 4,455,243; and 4,652,387.

The carboxylic ashless dispersants are reaction products of an acylating agent (e.g., a monocarboxylic acid, dicarboxylic acid or other polycarboxylic acid, or derivatives thereof) with one or more polyamines and/or polyhydroxy compounds. These products, are described in many patents, including British Patent Specification 1,306,529 and the following U.S. Pat. Nos.: 3,163,603; 3,184,474; 3,215,707; 3,219,666; 3,271,310; 3,272,746; 3,281,357; 3,306,908; 3,311,558; 3,316,177; 3,340,281; 3,341,542; 3,346,493; 3,381,022; 3,399,141; 3,415,750; 3,433,744; 3,444,170; 3,448,048; 3,448,049; 3,451,933; 3,454,607; 3,467,668; 3,522,179; 3,541,012; 3,542,678; 3,574,101; 3,576,743; 3,630,904; 3,632,510; 3,632,511; 3,697,428; 3,725,441; 3,868,330; 3,948,800; 4,234,435; and Re. No. 26,433.

There are a number of sub-categories of carboxylic ashless dispersants. One such sub-category which constitutes a preferred type is composed of the polyamine succinamides and more preferably the polyamine succinimides in which the succinic group contains a hydrocarbyl substituent, usually an alkenyl substituent, containing at least 30 carbon atoms. These dispersants are usually formed by reacting a polyamine with an alkenyl succinic acid or anhydride such as a polyisobutenyl succinic acid and anhydride wherein the polyisobutenyl group has a number average molecular weight of 500 to 5,000, preferably 700 to 2,500, and more preferably 700 to 1,400. The polyamine used in forming such compounds contains at least one primary amino group capable of forming an imide group on reaction with a hydrocarbon-substituted succinic acid or acid derivative thereof such an anhydride, lower alkyl ester, acid halide, or acid-ester. The literature is replete with descriptions of polyamines suitable for use in forming such carboxylic ashless dispersants. See for example U.S. Pat. No. 5,034,018 which describes not only simple polyamines but amido-amine adducts which are suitable for use in forming such carboxylic ashless dispersants. Representative examples of such dispersants are given in U.S. Pat. Nos. 3,172,892; 3,202,678; 3,216,936; 3,219,666; 3,254,025; 3,272,746; 4,234,435; and 5,034,018. As used herein the term "succinimide" is meant to encompass the completed reaction product from reaction between the amine reactant(s) and the hydrocarbon-substituted carboxylic acid or anhydride (or like acid derivative) reactant(s), and is intended to encompass compounds wherein the product may have amide, amidine, and/or salt linkages in addition to the imide linkage of the type that results from the reaction of a primary amino group and an anhydride moiety.

Another sub-category of carboxylic ashless dispersants which can be used in the compositions of this invention includes alkenyl succinic acid esters and diesters of alcohols containing 1–20 carbon atoms and 1–6 hydroxyl groups. Representative examples are described in U.S. Pat. Nos. 3,331,776; 3,381,022; and 3,522,179. The alkenyl succinic portion of these esters corresponds to the alkenyl succinic portion of the succinimides described above. Alcohols useful in preparing the esters include methanol, ethanol, 2-methylpropanol, octadecanol, eicosanol, ethylene glycol, diethylene glycol, tetraethylene glycol, diethylene glycol monoethylether, propylene glycol, tripropylene glycol, glycerol, sorbitol, 1,1,1-trimethylol ethane, 1,1,1-trimethylol propane, 1,1,1-trimethylol butane, pentaerythritol, dipentaerythritol, and the like.

The succinic esters are readily made by merely heating a mixture of alkenyl succinic acid, anhydrides or lower alkyl (e.g., $C_1$–$C_4$) ester with the alcohol while distilling out water or lower alkanol. In the case of acid-esters less alcohol is used. In fact, acid-esters made from alkenyl succinic anhydrides do not evolve water. In another method the alkenyl succinic acid or anhydrides can be merely reacted with an appropriate alkylene oxide such as ethylene oxide, propylene oxide, and the like, including mixtures thereof.

Still another sub-category of carboxylic ashless dispersants useful in forming compositions of this invention comprises an alkenyl succinic ester-amide mixture. These may be made by heating the above-described alkenyl succinic acids, anhydrides or lower alkyl esters or etc. with an alcohol and an amine either sequentially or in a mixture. The alcohols and amines described above are also useful in this embodiment. Alternatively, amino alcohols can be used alone or with the alcohol and/or amine to form the ester-amide mixtures. The amino alcohol can contain 1–20 carbon atoms, 1–6 hydroxy groups and 1–4 amine nitrogen atoms. Examples are ethanolamine, diethanolamine, N-ethanol-diethylene triamine, and trimethylol aminomethane. Representative examples of suitable ester-amide mixtures are referred to in U.S. Pat. Nos. 3,184,474; 3,576,743; 3,632,511; 3,804,763; 3,836,471; 3,862,981; 3,936,480; 3,948,800; 3,950,341; 3,957,854; 3,957,855; 3,991,098; 4,071,548; and 4,173,540.

As in the case of the other carboxylic ashless dispersants discussed above, the alkenyl succinic anhydride or like acylating agent is derived from a polyolefin, preferably a polyisobutene, having a number average molecular weight of 500 to 5,000, preferably 700 to 2,500, and more preferably 700 to 1,400. Likewise, residual unsaturation in the polyalkenyl substituent group can be used as a reaction site as for example, by hydrogenation, sulphurization, or the like.

The polymeric polyamine dispersants are polymers containing basic amine groups and oil solubilizing groups (for example, pendant alkyl groups having at least about 8 carbon atoms). Such materials include, but are not limited to, interpolymers of decyl methacrylate, vinyl decyl ether or a relatively high molecular weight olefin with aminoalkyl acrylates and aminoalkyl acrylamides. Examples of polymeric polyamine dispersants are set forth in the following patents: U.S. Pat. Nos. 3,329,658; 3,449,250; 3,493,520; 3,519,565; 3,666,730; 3,687,849; and 3,702,300.

Mannich base dispersants which can be used pursuant to this invention are condensation products formed by condensing a long chain hydrocarbon-substituted phenol with one or more aliphatic aldehydes, usually formaldehyde or a formaldehyde precursor, and one or more polyamines, usually one or more polyalkylene polyamines. Examples of Mannich condensation products, including in many cases boronated Mannich base dispersants, and methods for their production are described in the following U.S. Pat. Nos.: 2,459,112; 2,962,442; 2,984,550; 3,036,003; 3,166,516; 3,236,770; 3,368,972; 3,413,347; 3, 442,808; 3,448,047; 3,454,497; 3,459,661; 3,493,520; 3,539,633; 3, 558,743; 3,586,629; 3,591,598; 3,600,372; 3,634,515; 3,649,229; 3, 697,574; 3,703,536; 3,704,308; 3,725,277; 3,725,480; 3,726,882; 3, 736,357; 3,751,365; 3,756,953; 3,793,202; 3,798,165; 3,798,247; 3, 803,039; 3,872,019; 3,904,595; 3,957,746; 3,980,569; 3,985,802; 4, 006,089; 4,011,380; 4,025,451; 4,058,468; 4,083,699; 4,090,854; 4, 354,950; and 4,485,023.

The boron content of the gear oils of this invention can be supplied entirely by use of a boronated ashless dispersant. Alternatively the boron can be supplied in its entirety by use of one or other boron containing additive components, such as a boronated partial ester of a polyhydric alcohol which preferably is complexed with a succinimide (e.g., U.S. Pat. No. 4,455,243), by use of a finely dispersed hydrated inorganic borate (e.g., U.S. Pat. No. 3,997,454), or by use of one or more other types of suitable boron-containing additive components. The addition to the base oil of a combination of two or more different kinds of oil-soluble or dispersible boron-containing components, such as one or more boronated ashless dispersants together with a finely divided dispersed hydrated inorganic borate or a boronated partial ester of a polyhydric alcohol, is still another appropriate alternative. Preferably, at least 50 wt % and more preferably at least 75 wt % of the boron content of the compositions of this invention is introduced therein as boronated ashless dispersant. Most preferably, substantially the entire boron content of said composition (i.e., from 90 to 100% by weight of the boron content) is introduced into the compositions of this invention as one or more boronated ashless dispersants.

As noted above, the compositions of this invention are essentially metal-free and essentially halogen-free.

By this is meant that if any metal-containing additive component is employed, it is employed in amount such that the finished gear oil contains by weight a total of no more than 500 ppm of metal introduced by way of added metal-containing additive(s), and that if any halogen-containing additive component is employed, it is employed in amount such that the finished gear oil contains by weight a total of no more than 300 ppm of halogen introduced by way added metal-containing additive(s). Preferably, no metal-containing additive is used. Typically there may be trace amounts of chlorine in the finished gear oil introduced as an impurity in one or more of the additive components. For example, succinic derivative ashless dispersants wherein in the formation of the succinic acylating agent such as polyisobutenyl succinic anhydride it is common to react the polyisobutene with chlorine to enhance the reaction with maleic anhydride. Thus the finished product is likely to contain small amounts of chlorine. Likewise, certain organic sulfur antiwear and/or extreme pressure agents can contain small amounts of residual chlorine if chlorine-containing reagents are used in their manufacture. Such residual amounts of chlorine can be carried over into the finished ashless dispersant and thus introduced into the finished gear lubricant in this manner. Preferably however, deliberate use of halogenated additives in order to utilize their halogen content (e.g., for antiwear or extreme pressure performance) is avoided in the practice of this invention.

Preferred finished gear oils of this invention utilize components proportioned such that the kinematic viscosity of the composition at 100° C. is at least 13.5 cSt and the Brookfield viscosity of the composition at −40° C. is 50,000 cP or less. Also preferred are compositions characterized in that the sulfur-containing antiwear and/or extreme pressure agent is selected from sulfurized olefinic hydrocarbon, aliphatic polysulfides, and mixtures of sulfurized olefinic hydrocarbon and aliphatic polysulfides; in that the ashless dispersant consists essentially of at least one succinic derivative ashless dispersant selected from boronated alkenyl succinimides, boronated alkenyl succinic esters, and boronated alkenyl succinic ester-amides; and in that the entire boron content of the composition is introduced therein as the succinic derivative ashless dispersant; and in that the composition is devoid of any metal-containing additive.

The following examples in which parts and percentages are by weight illustrate the practice of this invention. These examples are not intended to limit, do not limit, and should not be construed as limiting the generic aspects of this invention in any manner whatsoever.

EXAMPLE 1

A gear additive package containing (i) a sulfur-phosphorus antiwear/extreme pressure additive combination formed by interaction among 37.6 parts of sulfurized isobutylene, 4.8 parts of dialkyl hydrogen phosphite, 6.6 parts of primary aliphatic monoamines and 1.0 part of mono- and dialkyl acid phosphates; (ii) 13.3 parts of trihydrocarbyl dithiophosphate; (iii) 3.3 parts of a thiadiazole copper corrosion inhibitor; 0.8 part of carboxylic acid rust inhibitors, 0.6 part of foam inhibitor, 12.7 parts of a 62% oil solution of a boronated succinimide ashless dispersant, and 19.5 parts of process oil diluent is added to a base oil consisting of (1) di-(2-ethylhexyl) sebacate, (2) a hydrogenated poly-α-olefin oligomer having a kinematic viscosity at 100° C. of about 40 cSt, (3) a hydrogenated poly-α-olefin oligomer having a kinematic viscosity at 100° C. of about 8 cSt, and (4) a hydrogenated poly-α-olefin oligomer having a kinematic viscosity at 100° C. of about 2 cSt. The components are proportioned such that the finished gear oil contains 3.25% of the additive package, 20.00% of the di-(2-ethylhexyl) sebacate, 62.50% of the 40 cSt oligomer, 2.00% of the 8 cSt oligomer and 12.25% of the 2 cSt oligomer. This GL-4 finished oil has a kinematic viscosity at 100° C. of 13.76, a Brookfield viscosity at −40° C. of 33,600 cP, a sulfur content of about 0.64%, a phosphorus content of about 0.062%, a nitrogen content of about 0.026%, a chlorine content of about 0,005%, and a boron content of about 0.0057%. The finished lubricant is devoid of any metal-containing additive.

EXAMPLE 2

A finished gear lubricant formed as in Example 1 was employed as the lubricant in new manual transmissions produced by a well-known transmission manufacturer. The transmissions were operated under cold conditions simulating wintertime exposure in cold climates, and under conditions known to produce the cold-clash problem. It was found that the gear lubricant of this invention eliminated the cold-clash problem. In particular, as compared to the best factory fill gear lubricant approved and specified by the manufacturer for use with this transmission, the ring blocking time in the transmission was reduced under various test conditions by use of the gear lubricant of this invention to time ranges between 5 and 10 seconds, which is deemed entirely satisfactory under these severe operating conditions. Further, the shift pressure that the operator had to apply to the shift knob to complete a gear shift was reduced by 20 to 30 pounds as compared to the best factory fill gear lubricant approved and specified by the manufacturer for use with this transmission.

EXAMPLE 3

In order to qualify for use as a manual transmission lubricant it is necessary that the finished gear oil not exhibit excessive antagonism towards various polymeric materials used in the fabrication of seals used in the transmissions. A finished gear lubricant formed as in Example 1 was subjected to the standard PG-1 and PG-2 seal tests using polyacrylate, nitrile, and fluoroelastomer (VITON® elastomer) seals. It was found that in each case, the seal performance was satisfactory at the end of 1000 hours of testing.

EXAMPLE 4

A GL-5 gear oil of this invention is formed by utilizing the components of Example 1 in proportions such that the finished lubricant contains 6.5% of the additive package and 93.5% of the base oil of Example 1.

EXAMPLE 5

A finished gear oil is formed as in Example 1 except that the 37.6 parts of sulfurized isobutylene is replaced by 37.6 parts of a combination of 60% sulfurized isobutylene and 40% dialkyl polysulfide.

EXAMPLE 6

A finished gear oil is formed as in Example 1 except that the dialkyl hydrogen phosphite, the primary aliphatic monoamines, the mono- and dialkyl acid phosphates and the trihydrocarbyl dithiophosphate are replaced by an equivalent amount of phosphorus as a product made by the following procedure: 53 parts of phosphorus pentoxide is added to 430 parts of hydroxypropyl-O,O'-di(4-methyl-2-pentyl)phosphorodithioic acid at 60°-63° C. within a period of 5.5 hours. The reaction mixture is heated to 75°-80° C. and held at this temperature for 2 hours. To this reaction mixture is added over a period of 1.5 hours 219 parts of a mixture of tertiary alkyl primary monoamines having 11 to 14 carbon atoms while controlling the temperature to 30°-60° C. Then the product mixture is maintained at 50°-60° C. for 0.5 hour and filtered. The resultant product should have a phosphorus content of about 8%, a sulfur content of about 10.4% and a nitrogen content of about 2.2%.

EXAMPLE 7

A finished gear oil is formed as in Example 1 except that (i) the sulfurized isobutylene is replaced by an equivalent amount of sulfur as a diisobutene polysulfide containing an average of 3.2 sulfur atoms per molecule prepared by stepwise reaction of isobutene with sulfur monochloride and sodium sulfide, and (ii) the dialkyl hydrogen phosphite, the primary aliphatic monoamines, the mono- and dialkyl acid phosphates and the trihydrocarbyl dithiophosphate are replaced by an equivalent amount of phosphorus as a product made by the procedure described in Example 6.

As used herein the term "oil-soluble" means that the material under discussion can be dissolved in or be stably dispersed in the base oil of this invention to at least the minimum concentration required for use as described herein. Preferably, the material has a solubility or dispersibility in the base oil well in excess of such minimum concentration. However the term does not signify that the material must dissolve or be dispersible in all proportions in the base oil.

Some additive components are supplied in the form of solutions of the active ingredient(s) in an inert diluent or solvent, such as a diluent oil. For example, ashless dispersants are usually provided in the form of such solutions. Unless expressly stated to the contrary, the amounts and concentrations of each additive component are expressed in terms of active additive—i.e., the amount of solvent or diluent that may be associated with such component as received is excluded.

The disclosures of each patent or patent publication cited in the foregoing disclosure is incorporated herein by reference as if fully set forth herein.

We claim:

1. An essentially metal-free and essentially halogen-free, boron-containing gear oil lubricant composition which comprises:

a) base oil consisting essentially of a blend of (1) di-(2-ethylhexyl)sebacate; (2) hydrogenated poly-α-olefin oligomer having a kinematic viscosity at 100° C. of about 40 cSt; (3) hydrogenated poly-α-olefin oligomer having a kinematic viscosity at 100° C. of about 8 cSt; and (4) hydrogenated poly-α-olefin oligomer having a kinematic viscosity at 100° C. of about 2 cSt, in proportions such that for each 100 parts by weight of (2) there are from about 24 to about 40 parts by weight of (1), from about 3 to about 12 parts by weight of (3), and from about 11 to about 20 parts by weight of (4);

b) about 0.7 to about 7 wt % of at least one oil-soluble organic sulfur-containing antiwear and/or extreme pressure agent having a sulfur content of at least about 20% by weight;

c) about 0.2 to about 3 wt % of at least one oil-soluble organic phosphorus-containing antiwear and/or extreme pressure agent;

d) about 0.05 to about 0.35 wt % of at least one oil-soluble copper corrosion inhibitor;

e) about 0.1 to about 0.8 wt % of at least one oil-soluble rust inhibitor;

f) about 0.005 to about 0.06 wt % of at least one oil-soluble foam inhibitor; and g) about 0.15 to about 3 wt % of at least one oil-soluble ashless dispersant;

all of the foregoing percentages being based on the weight of the total composition, said composition being still further characterized in that the sulfur:phosphorus weight ratio of said composition is in the range of about 8:1 to about 35:1, and in that the boron content of said composition is in the range of about 0.0025 to about 0.07 wt %.

2. A composition according to claim 1 wherein the components thereof are proportioned such that the kinematic viscosity of said composition at 100° C. is at least 13.5 cSt and the Brookfield viscosity of said composition at −40° C. is 50,000 cP or less, and wherein at least 50 wt % of the boron content of said composition is introduced therein as boronated ashless dispersant.

3. A composition according to claim 1 wherein said base oil is proportioned such that for each 100 parts by weight of (2) there are from about 28 to about 36 parts by weight of (1), from about 3 to about 6 parts by weight of (3), and from about 15 to about 20 parts by weight of (4), and wherein at least 75 wt % of the boron content of said composition is introduced therein as boronated ashless dispersant.

4. A composition according to claim 1 wherein said base oil is proportioned such that for each 100 parts by weight of (2) there are about 30 to about 34 parts by weight of (1), from about 3 to about 4 parts by weight of (3), and about 18 to about 20 parts by weight of (4), and wherein substantially the entire boron content of said composition is introduced therein as boronated ashless dispersant.

5. A composition according to claim 1 wherein said base oil blend is composed of about 32 parts by weight of (1), about 100 parts by weight of (2), from about 3 to about 4 parts by weight of (3), and about 18 to about 20 parts by weight of (4); wherein said sulfur-containing antiwear and/or extreme pressure agent is selected from sulfurized olefinic hydrocarbon, aliphatic polysulfides, and mixtures of sulfurized olefinic hydrocarbon and aliphatic polysulfides; wherein said ashless dispersant consists essentially of at least one succinic derivative ashless dispersant selected from boronated alkenyl succinimides, boronated alkenyl succinic esters, and boronated alkenyl succinic ester-amides; wherein the entire boron content of said composition is introduced therein as said succinic derivative ashless dispersant; and wherein said composition is devoid of any metal-containing additive.

* * * * *